United States Patent [19]

Kane et al.

[11] Patent Number: 4,858,781

[45] Date of Patent: Aug. 22, 1989

[54] WASTE CONTAINER AND ADJUSTABLE BAG LINER PACKAGE HOLDER COMBINATION

[75] Inventors: Richard Kane, Rochester; Carl Meyerhoefer, Dix Hills, both of N.Y.; David C. Miller, New Caanan; Thomas J. Pendleton, Danbury, both of Conn.

[73] Assignee: Mobil Oil Corporation, New York, N.Y.

[21] Appl. No.: 231,513

[22] Filed: Aug. 12, 1988

Related U.S. Application Data

[63] Continuation-in-part of Ser. No. 10, Jan. 2, 1987, Pat. No. 4,763,809.

[51] Int. Cl.[4] ..... B65D 21/02; B65D 67/02

[52] U.S. Cl. ..... 220/407; 220/62; 220/23.83; 220/339; 248/95; 312/333

[58] Field of Search ..... 220/23.2, 23.4, 23.83, 220/23.86, 62, 69, 339, 403, 407; 312/333; 297/462; 108/45, 102, 143; 211/153; 248/95, 97

[56] References Cited

U.S. PATENT DOCUMENTS

| | | | |
|---|---|---|---|
| 2,671,709 | 3/1954 | Radzyner . | |
| 2,869,620 | 1/1959 | Gleitsman . | |
| 3,195,966 | 7/1965 | Doherty . | |
| 3,553,762 | 1/1971 | Padgett, Jr. . | |
| 3,563,505 | 2/1971 | Langley . | |
| 3,664,622 | 5/1972 | Viccaro . | |
| 3,760,975 | 9/1973 | Nilsson . | |
| 3,856,173 | 12/1974 | Deane et al. . | |
| 3,888,406 | 6/1975 | Nippes . | |
| 3,913,810 | 10/1975 | Shaw . | |
| 3,979,011 | 9/1976 | Schleicher . | |
| 4,202,457 | 5/1980 | Tansi | 220/62 |
| 4,314,651 | 2/1982 | Gaiser | 220/339 |
| 4,347,537 | 8/1982 | Schoettle | 220/339 |
| 4,349,123 | 9/1982 | Yang . | |
| 4,364,490 | 12/1982 | Lang et al. . | |
| 4,760,921 | 8/1988 | Cicari | 206/509 |

*Primary Examiner*—George E. Lowrance
*Attorney, Agent, or Firm*—Alexander J. McKillop; Charles J. Speciale

[57] ABSTRACT

A rigid waste container having a bottom and walls and a peripherally depending rigid shift for offsetting the bottom of the container from a support surface. The skirt has one or more spaced orifices and affixed to the underside of the bottom of the container is a ratchet bar. A holder for a package of waste container liners is mounted on the side of the container. The holder includes a pawl arm, an upright member joined to the pawl arm and a pawl escapement tooth formed on the pawl arm. The holder is located through the orifice of the skirt so as to be in slideable engagement with the ratchet bar. This arrangement is adapted to receive a supply package of liner bags located between the upright member and the wall of the container. The supply package is of sufficient resiliency so as to permit locking engagement of the package between the upright member and the container. The holder is formed of one piece construction and is flat prior to assembly. The holder may be bent into an L-shape configuration and is retained in this configuration by a latching mechanism.

9 Claims, 3 Drawing Sheets

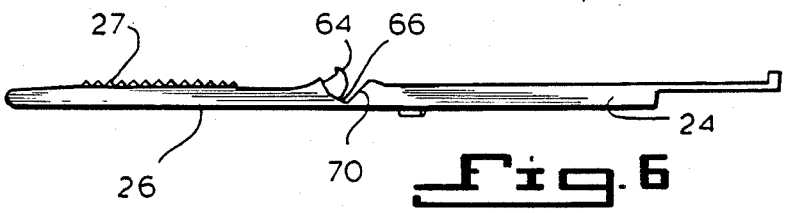
Fig. 6
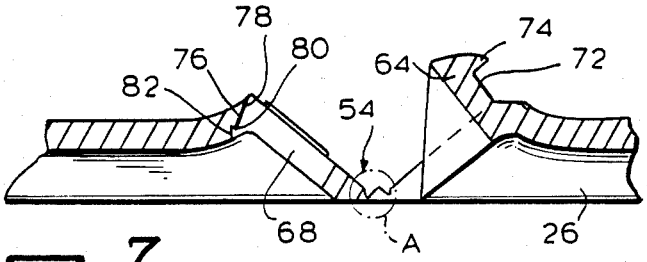
Fig. 7
Fig. 8
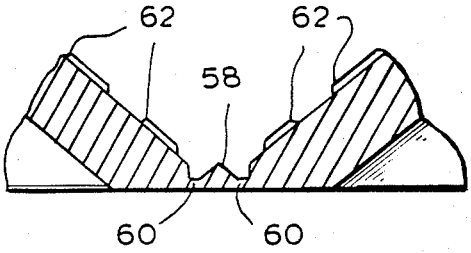
Fig. 9
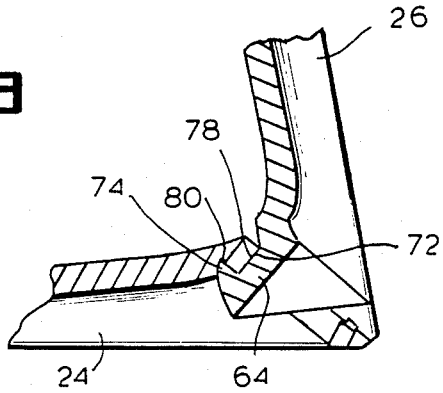

WASTE CONTAINER AND ADJUSTABLE BAG LINER PACKAGE HOLDER COMBINATION

CROSS-REFERENCE TO RELATED APPLICATIONS

This is a continuation-in-part of U.S. application Ser. No. 000,010, filed Jan. 2, 1987 now U.S. Patent No. 4,763,809.

BACKGROUND OF THE INVENTION

1. Field of the Invention

The present invention relates to the combination of a waste container having as an integral part thereof an adjustable holder for a package containing a supply of liner bags for the container.

1. Description of the Prior Art

An annoying lack of convenience in connection with waste containers requiring thin gauged film bag liners, is the fact that the liner replacement supply is usually somewhere remote from the container itself. It would amount to a significant advantage to the consumer if the container replacement liner supply were readily at hand adjacent to the container. Since boxes of bag liners come in different sizes it would be of practical necessity for the means to hold the boxes to be readily adjustable to accommodate the different sizes. Furthermore, while some liner containers are comparatively inflexible and not readily reducible in width as bag liners are removed, others may readily reduce in width and a holding means adjustable to accommodate this would be desirable.

U.S. Pat. No. 4,364,490 addresses this problem by placing a supply of bag liners under the bottom of a refuse receptacle, with the bag liner supplied from through the bottom of the container. This type of structure has the disadvantages of being structurally complex and, in addition, permits leaking waste liquid to run down into the bag liner supply from holes in the bag liner. U.S. Pat. No. 4,349,123 is another version of the same concept having exactly the same problems. U.S. Pat. No. 3,888,406 provides a waste container employed with a plurality of trash liner bags in a nested arrangement positioned within the container. This structure permits the use of the innermost nested liner first and when it is full it is removed from the nested configuration and the next liner is ready for use. A serious drawback with this configuration is the difficulty involved in denesting thin film, tightly nested bag liners. The removal of the full trash liner tends to pull out the entire nested arrangement disturbing one or more of the closely nested bags. The consumer then must reinsert and rearrange the nested configuration.

OBJECTS AND SUMMARY OF THE INVENTION

It is an object of the present invention to provide a holder for a package of waste container liners, which holder easily and conveniently mounts on the side of the waste container.

It is another object of the present invention to provide a combination waste container and liner package holder.

It is still another object of the present invention to provide a holder for a package of waste container liners, which holder can be shipped in a flat form and easily assembled by the consumer for use.

It is yet a further object of the present invention to provide a holder for a supply of bag liners positioned adjacent to the waste container in a manner not having the shortcomings of the prior art.

The objects of the present invention are attained by employing a combination comprising a unique arrangement in the bottom region of a waste container including, a structure which will firmly hold packages of bag liners of different size and any of decreasing size. The combination broadly comprises at least one ratchet bar fixed in association with a planar surface; at least one pawl including a pawl escapement tooth and a pawl arm in association therewith; a fulcrum for said pawl arm, located so as to permit said pawl tooth to move into and out of engagement with the teeth of said ratchet bar; an upright member fixed at the end of said pawl arm opposite to said pawl tooth and extending in the same direction as said pawl tooth; a wall member fixed in relation to said ratchet bar and located between said ratchet bar and said upright member and generally parallel to said upright member; said pawl tooth and arm being slideable in relation to said ratchet bar, fulcrum and wall member; said combination being adapted to receive a package between said upright member and said wall member, said upright member being structured so as to exert a spring-force against said package when said pawl escapement tooth is in locked engagement with said ratchet bar.

In a preferred combination there are a pair of spaced parallel ratchet bars, a pair of said pawls, a pair of said fulcrums and a pair of inwardly curved upright members.

The combination is best utilized wherein the above referenced planar surface is the underside of a rigid container having a bottom and side walls. This container will have a peripherally depending rigid skirt for offsetting the bottom of the container from a support surface. The skirt has a pair of spaced orifices therein functioning as the fulcrums for operation of the pawl arm and pawl escapement tooth.

In another preferred form of the invention, the liner package holder is formed as a one-piece molded product in a flat configuration. The upright member and the pawl arm are joined together with a hinge, all of which reside in substantially a single plane prior to assembling the holder. The hinge permits the holder to be bent into an L-shaped geometry, with the upright member substantially perpendicular to the pawl arm, such that it is in the proper configuration to secure a liner package to the waste container. The preferred form of the holder described above also includes a latching mechanism to keep the upright member disposed substantially perpendicularly to the pawl arm so that the holder retains its L-shaped geometry. The advantage of this preferred form of the invention is that the holder can be shipped flat, which saves costs in packaging, freight and storage, and yet the holder may be easily and quickly assembled by the consumer.

These and other objects, features and advantages of this invention will be apparent from the following detailed description of illustrative embodiments thereof, which is to be read in connection with the accompanying drawings.

BRIEF DESCRIPTION OF THE DRAWINGS

FIG. 6 is a side view of the liner package holder shown in FIG. 4.

FIG. 7 is a sectional view of a portion of the holder shown in FIG. 5, taken along line 7—7 of FIG. 5.

FIG. 8 is an enlarged view of that portion of the holder shown in circle A of FIG. 7.

FIG. 9 is a sectional view of that portion of the holder shown in FIG. 7, after assembly.

DETAILED DESCRIPTION OF THE PREFERRED EMBODIMENT

Figure 1:
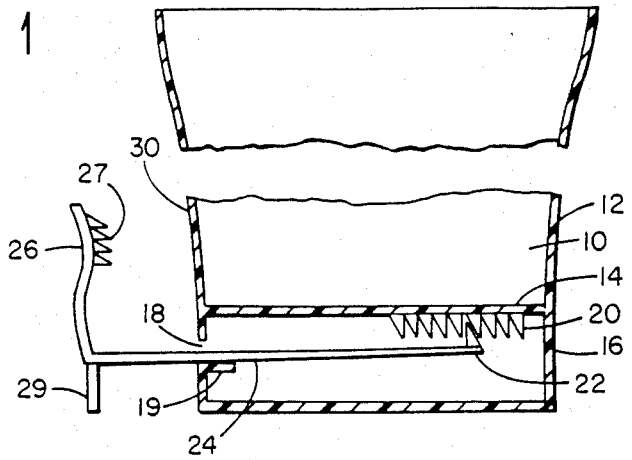
FIG. 1 is a side sectional view taken along line 2—2 of FIG. 2 of a waste container having the adjustable package holder of the present invention.

Referring to the drawings there is shown, the combination of a waste container 10, having side walls 12 and a planar bottom 14. Depending from the bottom of the container is peripheral skirt member 16. A pair of fulcrum orifices 18 extend through skirt member 16. Affixed to or molded as part of the bottom wall 14 of the container is at least one multitooth ratchet bar 20. Extending through orifices 18 is a pair of pawls which include a pawl escapement tooth 22, a pawl arm 24 and one or more upright members 26, which in the case of two or more, are interconnected by cross member 28. Shelf members 19 are perpendicular extensions of orifices 18 and provide broader support for pawl arm 24. Upright members 26 can be curved as shown or angled so as to provide a spring action against a package of bag liners held between them and the waste container wall. The inside surfaces of 26 can be serrated or toothed as at 27 to more firmly grip a package of waste container liners. When a package of waste container liner bags is placed in this holding means, the center of gravity of the container may be shifted causing the container to tip sideways. This can be avoided by providing a foot or leg 29 at the underside of the end of pawl arm 24.

Figure 2:
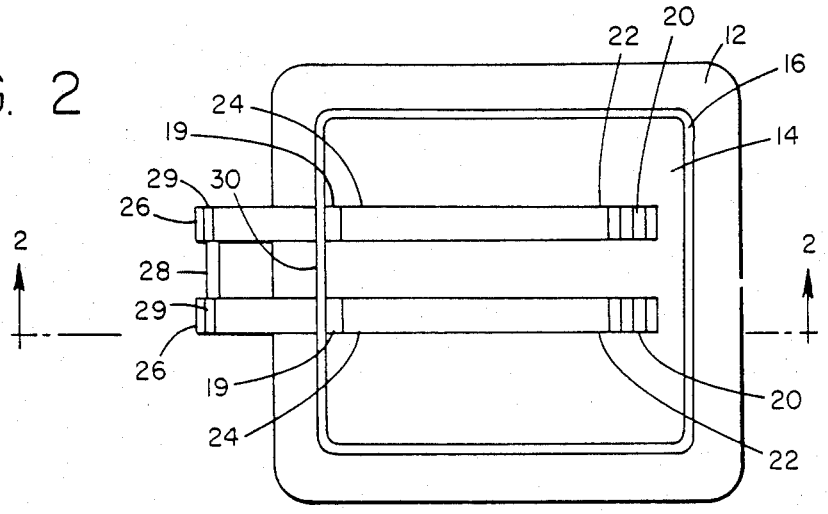
FIG. 2 is a bottom view of the waste container structure and the adjustable package holder.
Figure 3:
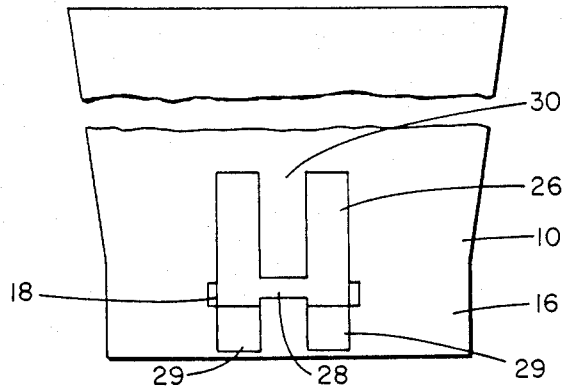
FIG. 3 shows a side view of the container as viewed from the end of the adjustable package holder.

By way of example the structure shown in FIGS. 1, 2 and 3 can be made of any suitable rigid material of either metal, wood, plastic or any other composite material. Suitable materials include aluminum, sheet steel, thermoplastic resin, e.g., polypropylene, polyethylene, impact polystyrene, etc. Container 10 can be of molded polyethylene having a wall thickness of approximately 1/16–3/16 inch. At the underside of the bottom 14 of the container there can be molded dual, spaced bars or tracks of a ratchet. The width of the ratchet teeth can be approximately from 1–1¼ inch wide. The teeth of the ratchet bar or track are designed to interengage with a pawl escapement tooth 22 of approximately the same width. The pawl tooth can have a flat pawl arm of molded polyethylene which also can be anywhere from 1/16 to 3/16 inch in thickness. A pair of pawl arms with associated pawl tooth can be molded in one piece so as to have an upright member at right angles to the pawl arm and of the same thickness. In the case of a pair of pawls they will be molded together and connected by a molded cross member 28.

Waste container liners are normally supplied to the consumer in paperboard boxes which contain a plurality of such liners. The box when full of folded bag liners, has a certain amount of resiliency. These boxes are usually rectangular in shape, having a width which varies depending upon the size and number of folded bags therein. The container usually has a perforated region which can be removed so as to provide access to the folded bags from between members 26. When such a package or box is placed between upright member 26 and area 30 of wall 12 of the waste container it can be securely fixed in this location. By exerting a pushing pressure against upright members 26 the package and the spring action of members 26 will be resilient enough to permit pawl escapement tooth 22 to advance in a package tightening direction over the individual teeth of ratchet bar member 20 until the point is reached where the package is securely held in place between upright members 26 and region 30 of the container wall. If the package thickness decreases, due to the removal of individual bags, it can be kept secure by pushing upright members 26 again in a direction so as to advance escapement tooth 22 to a new and more secure location on ratchet bar 20. The waste container can be of any practical design, e.g., of square or rectangular base, circular or triangular base.

FIGS. 4 through 9 illustrate a second preferred form of the liner package holder of the present invention. In this preferred form, the liner package holder is of one-piece construction and is formed flat, prior to assembly.

Figure 4:
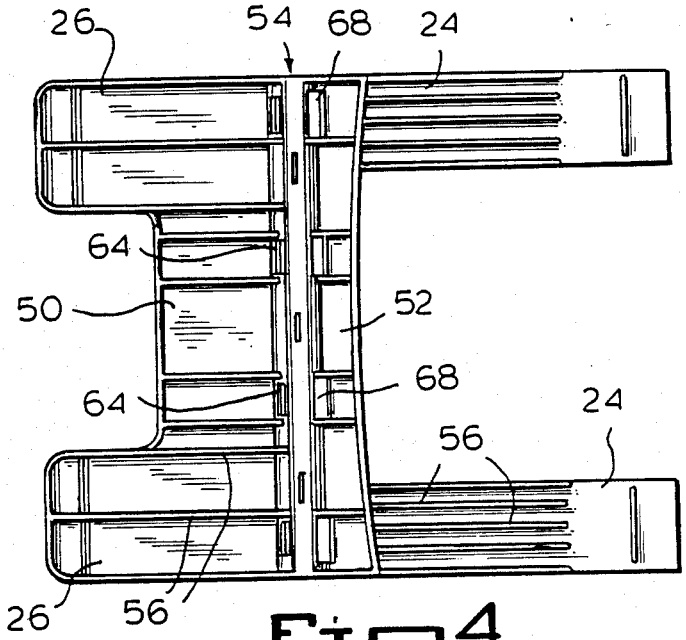
FIG. 4 is a bottom plan view of a liner package holder, formed in accordance with a second form of the present invention.
Figure 5:
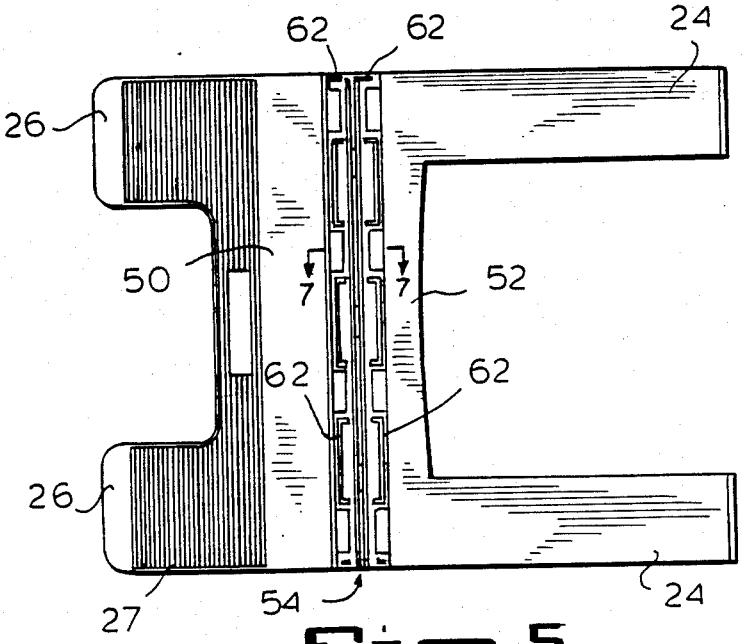
FIG. 5 is a top plan view of the liner package holder shown in FIG. 4.

As shown in FIGS. 4 through 6, the liner package holder includes one or a pair of parallel upright members 26, interconnected by a first cross member 50, as in the previously described embodiment illustrated by FIGS. 1 through 3. The holder also includes one or a pair of parallel pawl arms 24, also interconnected by a second cross member 52. The holder further includes a hinge 54 which joins the upright members 26 to the pawl arms 24 and which allows the upright members to pivot with respect to the pawl arms so that the holder may be bent into an L-shaped geometry, with the upright members 26 disposed substantially perpendicularly to the pawl arms 24, which is the proper configuration of the holder for securing a package of liners to the waste container. The holder further includes a latching mechanism to keep the upright members 26 disposed substantially perpendicularly to the pawl arms 24 so that the holder retains its L-shaped geometry after assembly.

The bottom side of the holder, as shown in FIG. 4, preferably includes a plurality of parallel, spaced-apart ribs 56 formed along the upper members 26 and the pawl arms 24, which are provided for strengthening the upper members and the pawl arms.

The top side or inner surfaces of the holder is shown in FIG. 5. As illustrated, the free end of each pawl arm 24 includes a protruding pawl tooth 22 extending perpendicularly to the major portion of the arm. As in the embodiments of FIGS. 1 through 3, the pawl teeth 22 are provided to engage the teeth of the spaced-apart ratchet tracks 20 formed on the waste container. The inside surface (top surface shown in FIG. 5) of the upright members may be serrated or toothed as at 27, as in the previous embodiments, to more firmly grip a package of waste container liner bags.

The hinge 54 of the holder is shown in more detail in FIGS. 7 and 8. It is, preferably, a living hinge, as the entire holder is preferably integrally formed and molded from a thermoplastic material, e.g., polypropylene, polyethylene, impact polystyrene, etc. Although other types of hinges are suitable for use, its purpose is to join the upright members 26 and the pawl arms 24, and their associated cross members 50, 52 together, and yet allow the upright members to pivot relative to the pawl arms.

The preferred form of the hinge includes a triangular-shaped, relatively thickened central portion 58, and two parallel portions 60 of reduced thickness on opposite sides of the central portion 58. The hinge allows the holder to flex at the two reduced thickness portions 60 so that the holder may be bent from an overall flat configuration, where the hinge 54, upright members 26 and pawl arms 24 reside in substantially a single plane, to an L-shaped configuration, with the upright members 26 being disposed substantially perpendicularly to the pawl arms 24. This L-shaped configuration of the holder is the desired form for use in securing a liner package to the waste container, as described in the previous embodiments.

As shown in FIGS. 5 and 8, the inner surface or top side of the holder may include raised abutment surfaces 62 symmetrically positioned on opposite sides of the hinge on the upright members 26 and the pawl arms 24 and their associated cross members 50, 52, and preferably on sloped portions 66, 70, which will be described further. The abutment surfaces 62 on one side of the hinge engage their corresponding abutment surfaces 62 on the other side to ensure that the upright members and pawl arms meet properly with little or no play when the holder is assembled into its usable L-shaped form.

The preferred form of the liner package holder described above also includes a latching mechanism. As previously mentioned, the latching mechanism ensures that the holder stays in its L-shape configuration, with the upright members 26 disposed substantially perpendicularly to the pawl arms 24, once the holder is assembled for use.

The preferred form of the latching mechanism is shown in FIGS. 5, 7 and 9. Basically, the mechanism includes one or a series of spaced-apart projections 64 formed in a straight line on a sloped portion 66 of the upright members 26 and their cross member 50 along one side of the hinge 54, and one or a series of spaced-apart openings 68 also formed in a straight line on an oppositely sloped portion 70 of the pawl arms 24 and their associated cross member 52 and along the other side of the hinge. The projections 64 and openings 68 are positioned so that they are in alignment on opposite sides of the hinge 54 and so that each projection 64 may enter and be received by a corresponding opening 68. Of course, it is envisioned to be within the scope of the invention that the positions of projections 64 and openings 68 may be switched, that is, the projections may be formed on the pawl arms 24 and cross member 52, and the openings may be formed on upright members 26 and cross member 50.

Each projection 64 further includes on one of its sides a flat surface 72 and a tooth or hook 74 extending outwardly of the flat surface 72. Each opening 68 is at least partially defined by an inner wall 76 of the pawl arm 24 and cross member 52, which inner wall 76 includes a flat surface 78 having an exposed edge or lip 80, and a recess or V-shaped groove 82 disposed inwardly of the exposed lip 80.

When the liner package holder is assembled by bending it at the hinge, the projections 64 are received by their corresponding openings 68 such that the flat surfaces 72, 78 of the projections 64 and inner wall 76 of the opening are disposed adjacent to each other and the hook 74 of each projection engages the lip 80 and is at least partially received by the V-shaped groove 82 formed in the inner wall 76 of its corresponding opening.

The projections 64 are preferably formed with a length such that they engage the flat surfaces 78 of the inner walls of the openings. They are also formed with rounded top free ends 84, and are made to be at least slightly resilient.

As the holder is being bent, the rounded top end 84 of each projection 64 engages the flat surface 78 of the inner wall 76 of a corresponding opening. The hook 74 of the projection slips past the flat surface 78 of the inner wall of the opening and resiliently snaps into the V-shaped groove 82, thus engaging and hooking onto the exposed lip 80. The projections 64 are retained thusly within the openings 68, with the sloped portions 66, 70 of the upright members 26 and pawl arms 24 and their associated cross members 50, 52 facing each other, and with opposite abutment surfaces 62 in contact with each other. The liner package holder is thus retained in an L-shaped configuration and ready for mounting on the side of waste container and for receiving a package of liner bags between its upright members 26 and the waste container wall 12, as described in the previous embodiments.

The advantage of the above-described embodiment is that the liner package holder may be shipped flat, rather than in its assembled L-shape configuration. The ability of the holder to be formed in a flat configuration and assembled by the consumer after it is purchased saves considerably on the cost of packaging, freight and storage. The latching mechanism, hinge and one-piece construction of the holder described above allows the holder to be easily assembled, with no intricate assembly of separate parts being required, so that an average consumer may easily bend and latch the holder into its L-shape configuration, ready for use.

In the manner described above the subject combination of a cooperating holder and waste container provides a means of storing any size package of plastic liner or garbage bags in the proximity of the waste container. In this manner spare bags are always in the vicinity of the waste container. Bag removal from the container and replacement of a used box is quite simple. Providing a waste container with this combination has the added advantage of yielding a highly efficient stackable product which tends to hold down freight costs. An additional advantage of this type of storage and supply system is that it tends to further stabilize the waste container since its center of gravity is lowered by virtue of the position of a supply package.

Although the various aspects of the present invention have been described with respect to the preferred embodiments thereof, it will be understood that the invention is entitled to protection within the full scope of the appended claims.

What is claimed is:

1. The combination comprising a rigid container having a bottom planar surface and a wall member, at least one ratchet bar fixed in association with said planar surface, at least one pawl including a pawl escapement tooth and a pawl arm in association therewith; said container having a peripherally depending rigid skirt for offsetting the bottom of said container from a support surface, at least one orifice in said skirt functioning as a fulcrum for said pawl arm located so as to permit said pawl tooth to move into and out of engagement with the teeth of said ratchet bar; an upright member fixed at the end of said pawl arm opposite to said pawl tooth, said pawl tooth and arm being slideable in relation to said ratchet bar, fulcrum and wall member, and a hinge pivotally joining the upright member to the pawl arm such that the upright member may be pivoted with respect to the pawl arm and positioned so as to extend in the same direction as said pawl tooth; said combination being adapted to receive a package, which is decreasible in size, between said upright member and said wall member, said upright member being structured so as to exert a spring-force against said package when said pawl escapement tooth is in locked engagement with said ratchet bar.

2. The combination comprising at least one ratchet bar fixed in association with a planar surface; at least one pawl including a pawl escapement tooth and pawl arm in association therewith; a fulcrum for said pawl arm located so as to permit said pawl tooth to move into and out of engagement with the teeth of said ratchet bar; an upright member joined at the end of said pawl arm opposite to said pawl tooth; a hinge pivotally joining the upright member to the pawl arm such that the upright member may be pivoted with respect to the pawl arm and positioned so as to extend in the same direction as said pawl tooth; a wall member fixed in relation to said ratchet bar and located between said ratchet bar and said upright member and generally parallel to said upright member; said pawl tooth and arm being slideable in relation to said ratchet bar, fulcrum and wall member; said combination being adapted to receive a package between said upright member and said wall member, said upright member being structured so as to exert a spring-force against said package when said pawl escapement tooth is in locked engagement with said ratchet bar.

3. In combination:

a waste container having a bottom planar surface and a wall member, at least one ratchet bar fixed in association with said planar surface, and a peripherally depending skirt for offsetting the bottom of said container from a support surface, the skirt having at least one orifice formed therein; and a holder for a package of inner liners for the waste container, the holder including at least one pawl arm having a pawl escapement tooth mounted thereon and positioned near one end thereof, an upright member joined to the end of the pawl arm opposite to said pawl tooth, a hinge pivotally joining the upright member to the pawl arm such that the upright member may be pivoted with respect to the pawl arm and positioned so as to extend in the same direction as said pawl tooth;

the holder being mounted on the waste container such that the pawl arm is at least partially received by the skirt orifice, the orifice functioning as a fulcrum for the pawl arm located so as to permit said pawl tooth to move into and out of engagement with the teeth of said ratchet bar;

the holder being adapted to receive a package of container inner liners between the holder and the container, said upright member of the holder being structured so as to exert a spring-force against said package when said pawl escapement tooth is in locked engagement with said ratchet bar.

4. The combination defined by claim 3, wherein said holder is formed of a one-piece construction; and wherein the holder is configurable in a first state, wherein the upright member, hinge and pawl arm reside in substantially the same plane, and a second state, wherein the upright member is disposed substantially perpendicularly to the pawl arm.

5. The combination defined by claim 4, wherein the holder further includes a latching mechanism for retaining the holder in the second state with the upright member disposed substantially perpendicularly to the pawl arm, the latching mechanism including at least one projection formed on one of the upright member and the pawl arm, and at least one opening formed in the other of the upright member and the pawl arm, said other of the upright member and pawl arm having an inner wall which partially defines the opening, the projection being adapted to be received by the opening and to latchingly engage the inner wall.

6. The combination defined by claim 5, wherein the projection includes a hooked portion extending therefrom, and the inner wall defining the opening includes a lip and a groove formed therein, the hooked portion of the projection engaging the lip and being received by the groove of the inner wall when the holder is in the second state.

7. The combination defined by claim 5, wherein the projection is formed as a resilient member and with a hooked portion extending therefrom, and wherein the inner wall defining the opening includes an exposed lip and a groove formed therein, the projection slidingly engaging the inner wall and the hooked end thereof engaging the lip and resiliently being received by the groove of the inner wall when the holder is in the second state.

8. The combination defined by claim 5, wherein the upright member includes a sloped portion adjacent to one side of the hinge, and the pawl arm includes an oppositely sloped portion adjacent to the other side of the hinge, the projection being disposed on one of the sloped portions of the upright member and pawl arm, and the opening being formed in the other of the sloped portions of the upright member and pawl arm.

9. The combination defined by claim 4, wherein the upright member includes a raised abutment surface formed thereon and on one side of the hinge, and wherein the pawl arm includes a raised abutment surface formed thereon and on the opposite side of the hinge, the abutment surfaces of the upright member and the pawl arm engaging one another when the holder is in the second state.

* * * * *